US005188553A

United States Patent [19]

Dougherty

[11] Patent Number: 5,188,553

[45] Date of Patent: Feb. 23, 1993

[54] FLAT FRONT PANEL CRT BULB PRE-STRESSED PRIOR TO FINAL EVACUATION AND METHOD OF MAKING SAME

[75] Inventor: Lawrence W. Dougherty, Sleepy Hollow, Ill.

[73] Assignee: Zenith Electronics Corporation, Glenview, Ill.

[21] Appl. No.: 681,220

[22] Filed: Apr. 5, 1991

[51] Int. Cl.[5] ..... H01J 9/26

[52] U.S. Cl. ..... 445/8; 220/2.1 A; 445/45; 65/41; 65/42

[58] Field of Search ..... 220/2.1 A, 2.3 A; 445/8, 45; 65/41, 42

[56] References Cited

U.S. PATENT DOCUMENTS

| | | | |
|---|---|---|---|
| 2,866,298 | 12/1958 | Babcock et al. | 65/43 |
| 3,894,858 | 7/1975 | Rogers | 65/41 X |
| 4,152,036 | 5/1979 | Corson | 65/41 X |
| 4,720,657 | 12/1985 | Tischer | 313/497 |
| 4,788,471 | 11/1988 | Strauss | 220/2.1 A X |
| 5,080,622 | 1/1992 | Tuin et al. | 445/8 |

OTHER PUBLICATIONS

Derwent Patent Abstract E7858A/25 for non-English Patent DS 1948-739 dated Jun. 15, 1978.

*Primary Examiner*—Kenneth J. Ramsey
*Attorney, Agent, or Firm*—Roland W. Norris

[57] ABSTRACT

A CRT bulb that has been preloaded to counter the atmospheric load placed on the seal area of an evacuated and sealed CRT is disclosed along with methods of constructing the bulb. The front panel is simply supported on the funnel and deflected inwardly during affixation of the panel to the funnel to form the bulb. When the deflection load is removed from the affixed panel, the resultant strain energy imparted to the bulb seal area offsets at least some of the atmosphericly induced strain on the sealed CRT. The bulb has a more evenly balanced stress distribution between the front panel and the funnel seal area than previous flat panel CRTs, enabling the use of thinner front panels and seal land.

16 Claims, 2 Drawing Sheets

FLAT FRONT PANEL CRT BULB PRE-STRESSED PRIOR TO FINAL EVACUATION AND METHOD OF MAKING SAME

BACKGROUND OF THE INVENTION

1. Field of the Invention

The present invention relates generally to cathode ray tube (CRT) bulbs. More specifically, the present invention relates to CRT bulbs having flat front panels, or faceplates, suitable for use with flat tensioned shadow masks.

2. Discussion of the Related Art

As is known the art of CRT construction, a CRT bulb is formed from a screen-bearing front glass panel affixed to a glass funnel section with cementitious material, normally a devitrifiable solder glass, or "frit". A CRT envelope is then formed by sealing an electron gun into a neck section of the bulb opposite the screen. The CRT envelope is then evacuated and sealed to become an operational, or finished, CRT.

Because the CRT is evacuated, atmospheric pressure produces stress on the CRT envelope. Thus the CRT must be designed so that the weakest portion of its envelope is able to withstand this atmospheric loading. The funnel-to-panel seal area, hereinafter "seal area", is one such weak area largely because the frit has a lower stress limit than the surrounding funnel and panel and because large bending moments are typically generated in this area due to panel deflection.

In the common CRT spherical faceplate, the faceplate, being analogous to an arch, has a shape which inherently resists the atmospheric load on the CRT. However, in the case of a tensioned mask CRT, which most commonly uses a flat front panel, the flat front panel shape does not inherently resist the atmospheric loading as well as a spherical panel.

In standard construction of the flat front panel CRT, the flat front panel is connected by frit to the funnel to form a rigid bulb without any significant stress placed on the front panel. Upon evacuation of the envelope, as the front panel deflects, large bending stresses will be placed on the frit and frontal seal land creating a potential failure point. In order to minimize the panel deflection and deflection-induced seal area stress, standard flat front panel CRT construction utilizes a thick glass for a stiffer front panel and a thick funnel seal land. The thick front panel will reduce deflection induced strains in the seal area and the thickened front seal land is incorporated into the funnel to further resist the remaining strain. However, in this arrangement, the thick front panel, being designed primarily for stiffness, is stressed well below its allowable limits and therefore represents wasted material in terms of envelope strength. While less susceptible to deflection, the thickened bulb members add weight and attendant material, and increased panel and/or funnel manufacturing and CRT processing time and shipping costs to the CRT.

Thus, it would be desirable to redistribute stress in an evacuated CRT bulb by reducing stress on the funnel seal land and frit while increasing stress in the panel to obtain good bulb strength while being able to utilize a thinner front panel or a narrower seal edge, or a combination of both. Conversely, a stronger CRT envelope may be made by utilizing bulb members of currently standard thicknesses.

OBJECTS OF THE INVENTION

It is an object of the invention to provide a CRT bulb which more efficiently distributes the stresses placed on the bulb members caused by atmospheric loading on the evacuated CRT.

It is also an object of the invention to enable the use of a pre-stressed bulb design to obtain thinner front panels and/or narrower seal edges, on flat panel CRTs than is possible with current unpre-stressed bulb manufacturing techniques.

BRIEF DESCRIPTION OF THE DRAWINGS

Other attendant advantages will be more readily appreciated as the invention becomes better understood by reference to the following detailed description and compared in connection with the accompanying drawings in which like reference numerals designate like parts throughout the figures. It will be appreciated that the drawings may be exaggerated for explanatory purposes.

DESCRIPTION OF THE PREFERRED EMBODIMENTS

Figure 1:
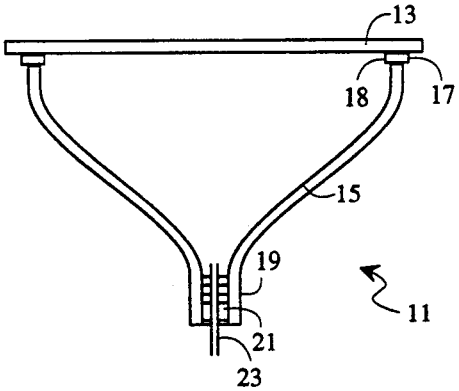
FIG. 1 is a cross section of a CRT prior to evacuation and sealing.

As seen in FIG. 1, a flat tension mask (FTM) CRT envelope 11 comprises a glass flat front panel 13 and a substantially conical glass funnel 15 hermetically sealed together. The funnel 15 and panel 13 are most commonly joined by application of heat to a cementious material 17, which is a television grade devritrifying solder glass known in the art as frit. Shown schematically in a cured, or hardened, state 18. Extending from the funnel 15 is a glass neck 19 into which is hermetically sealed an electron gun 21 by fusing the neck glass thereto. The envelope 11 is evacuated through a tube 23 extending through the gun 21 and the tube 23 is sealed completing an evacuated and operational CRT. Operational components not necessary to a disclosure of the present invention have been omitted but will be understood by the artisan to be present.

Figure 2:
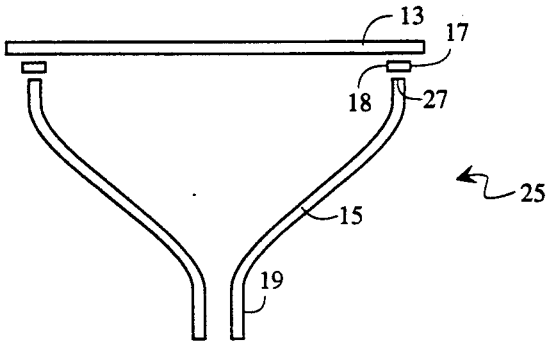
FIG. 2 is an exploded cross section of a CRT bulb.

As seen in the exploded schmetic representation of FIG. 2, a bulb 25 comprising the front panel 13, funnel 15, frit 17, and neck 19 are assembled as a rigid body by applying frit 17 between the panel 13 and funnel 15, abutting the panel 13 to the funnel 15, at the funnel seal land 27, and applying heat to change the frit from a dry, or pastelike, suspension to hardened ceramic solid.

According to the present invention, the pre-stressed bulb 25 resulting from the joining of the panel 13 to the funnel 15 will have a seal land 27 and frit 17 pre-stressed counter to the atmospheric load placed on the sealed CRT envelope 11 and a front panel bearing some initial stress due to its inward deflection during formation of the bulb. This pre-stressing occurs by loading the panel 13 to deflect it in the direction of the bulb interior i.e., inwardly along the axis of the tube, during its incorporation into the rigid body of the bulb 25. Once incorporation, ie. bulb formation, is complete, the deflection force on the panel 13 is removed and the incorporated panel 13 seeks return toward its predeflected state. The resultant strain energy stored in the bulb seal area will then counter the axial atmospheric load on the panel of the evacuated bulb offsetting at least a portion of the panel deflection stress on the seal area, thus permitting a narrower seal edge while resulting in increased, and favorably re-distributed, panel stress.

Figure 3:
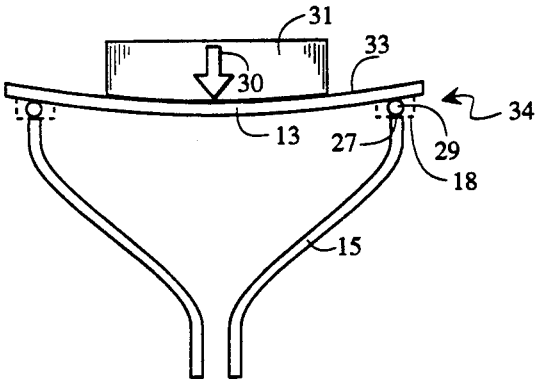
FIG. 3 illustrates a method of applying a deflection load to the simply supported front panel by utilizing a weight and gravity.

As seen in FIG. 3, the panel 13 has been placed in the desired position on the funnel seal land 27 with an uncured or plastic frit 29 therebetween. At this stage the panel 13 is simply supported, ie. free to flex independently of the funnel 15 on which it rests. The bulb components are then heated by traversing the assembly through a large oven. At a point before the uncured frit 29 devitrifies or solidifies, a panel deflection load 30, here represented by weight 31, is applied to the panel 13 causing it to deflect inwardly of the funnel 15. The panel 13 is thereby stressed without exerting substantial stress on the seal area 34 and uncured frit 29. The weight 31 may be preheated or retained within the oven so as not to act as a heatsink during thermal processing. Care must also be taken to prevent damage to the exterior surface 33 of the panel during placement of the weight.

Once the frit 29 has solidified, a bulb seal area 34 spanning the panel 13, solidified frit 18 (shown in phantom), and funnel seal land 27, is formed. Because the seal area 34 was formed with the panel 13 in a deflected and stressed state, no substantial stress is transferred from the panel 13 to the rigid body of the bulb seal area 29 until the deflection load 30 is removed. Upon removal of the deflection load 30 the panel 13 seeks return toward its normal, flat, undeflected state, thus distributing a strain energy equal, but opposite to the deflection load 30 across the seal area 34. This counteractive prestress load thus offsets a portion of atmospheric load on the sealed CRT equal to the amount of deflection load used in prestressing.

It will be noted that the deflection load 30 and resultant bulb counter stress need not equal the total atmospheric load on the panel 13 of the evacuated CRT. It may be a lesser amount providing significant seal area counter stress while being commensurate with the material properties of the envelope components and other manufacturing and CRT design parameters. It is also noted that a simply supported front panel unconnected to a rigid bulb may fail under full atmospheric load.

Figure 4:
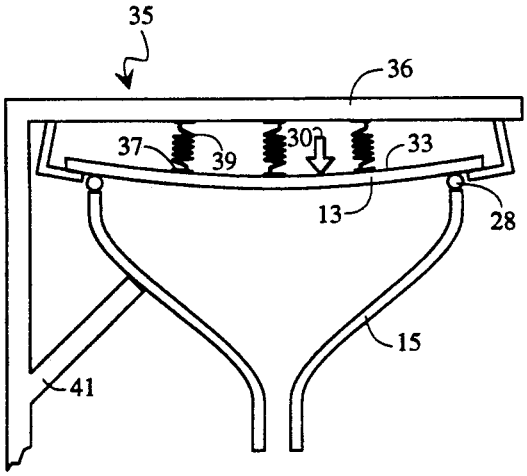
FIG. 4 illustrates a method of applying a deflection load to the simply supported front panel by utilizing mechanical fixturing.

As seen in FIG. 4, the deflection load 30 may be supplied to the panel 13 by mechanical apparatus such as a fixture 35 having a frame 36 over-lying the panel 13 to which are attached spring loaded blocks 37. The springs 39 will then supply the requisite deflection force 30 to the panel 13. The fixture 35 may be suitably attached to the carriage 41 used to support the bulb elements on their journey through the oven. Alternatively, screws or fluid driven rams (not shown), or the like, may be used in place of the springs 39 for application of the deflection load 30. Care again must be taken that the fixture parts contacting the panel external surface 33 do not damage it.

Figure 5:
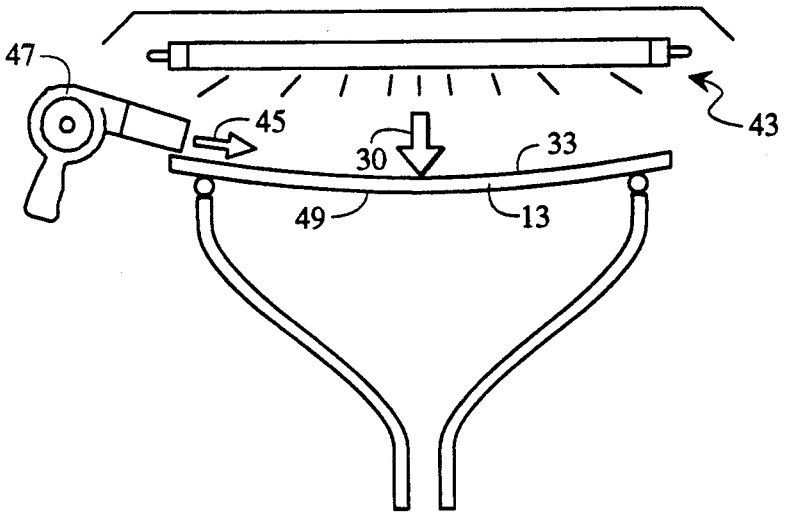
FIG. 5 illustrates a method of applying a deflection load to the simply supported front panel by utilizing a radiant heater and temperature gradient producing means.

As seen in FIG. 5, thermal means are used to induce the deflection load 30 into the panel 13. An infra-red heater 43 or other suitable radiant heat source is directed onto the panel 13. Much of their energy will pass through the panel and directly heat the interior phosphor screen surface. Temperature controlled air 45 is simultaneously forced across the panel external surface 33 by a blower 47 causing that surface to cool and create a temperature gradient which pre-deflects the panel in the desired fashion during frit crystallization. The resulting temperature balance must maintain correct temperature at the seal area to allow proper thermal curing of the frit.

Figure 6:
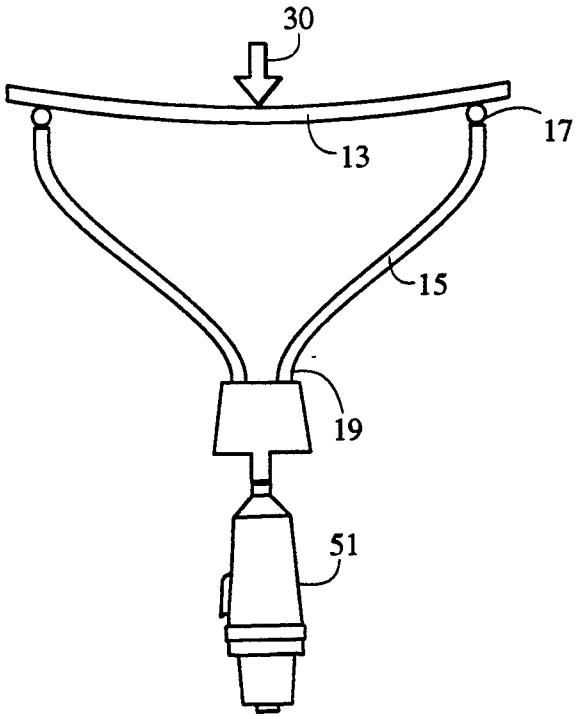
FIG. 6 illustrates a method of applying a deflection load to the simply supported front panel by utilizing a vacuum to at least partially evacuate the bulb.

As seen in FIG. 6, the deflection load 30 may be imposed on the panel 13 by evacuating, or partially evacuating, the bulb 25 with a vacuum apparatus 51 connected to the bulb neck 19 at that range in the thermal cycle where the frit has begun to liquefy or become partially crystalline. At this stage the frit 17 may provide an effective air seal between the panel 13 and funnel 15 while not sustaining any significant stress. This action allows the panel deflection load 30 to be applied as desired before the frit fully solidifies. As the behavior of the frit is predicable through the thermal cycle, only a reasonable experimentation should be required by the artisan to accomplish this method.

It will be appreciated that the embodiments of FIGS. 5–6 do not require a physical member to contact the external surface 46 of the panel 13 and therefor present less chance of marring the surface.

While the present invention has been illustrated and described in connection with the preferred embodiments, it is not to be limited to the particular structure shown, because many variations thereof will be evident to one skilled in the art and are intended to be encompassed in the present invention as set forth in the following claims.

Having thus described the invention, what is claimed is:

1. A method of manufacturing a CRT having a flat face panel which results in reduced panel-to-funnel seal area stress, comprising, in order:

a) abutting a flat CRT front panel to a CRT funnel without rigid connection therebetween;

b) deflecting the panel inwardly of the funnel without substantially stressing the funnel seal land; and, c) rigidly connecting the panel to the funnel at the seal land while the panel is deflected to produce a CRT bulb in which the funnel seal area is prestressed counter to atmospheric loading.

2. The method of claim 1 including:

deflecting the panel a significant percentage of the total panel deflection distance occurring under atmospheric loading of the evacuated CRT.

3. The method of claim 1 including:

placing a cement between the panel and the funnel, the cement having both rigid and nonrigid phases

4. The method of claim 3 including deflecting the panel without stressing the cement.

5. The method of claim 3 wherein the cement is a devitrifying solder glass.

6. The method of claim 1 including:

deflecting the panel by application of force to its exterior surface.

7. The method of claim 1 including deflecting the panel by means of gravity loading the panel.

8. The method of claim 1 including deflecting the panel by means of spring loading the panel.

9. The method of claim 1 including deflecting the panel by means of vacuum loading the panel.

10. The method of claim 1 including deflecting the panel by thermal means.

11. The method of claim 10 including causing a thermal gradient in the panel.

12. A method of processing a CRT bulb for reduced seal area stress when evacuated, comprising:

a) applying frit to the funnel-to-panel seal;

b) assembling the funnel and panel;

c) loading the panel axially inwardly while devitrifying the frit;

such that upon removal of the loading, the seal area experiences a counteractive loading effective to offset at least a portion of the atmospheric loading on the bulb when evacuated and sealed.

13. A CRT bulb comprising:

a panel rigidly affixed to a funnel, the funnel having a funnel seal area encompassing the funnel material adjacent the seal, the funnel seal area being constructed and arranged to have a permanent stress in the seal area which is counter to a stress on the funnel resulting from a substantially axial atmospheric load placed on the panel when the bulb is evacuated to make a finished CRT.

14. The CRT bulb of claim 13 wherein the panel has significant stress therein to result in reduced stress on the funnel seal area and frit when the bulb is evacuated.

15. The CRT bulb of claim 14 wherein the panel is flat and skirtless.

16. The CRT bulb of claim 13 wherein the panel is flat and skirtless.

* * * * *